US010245519B1

(12) United States Patent
Spiegel

(10) Patent No.: US 10,245,519 B1
(45) Date of Patent: Apr. 2, 2019

(54) TOY VEHICLE

(71) Applicant: Greg Spiegel, Land O'Lakes, FL (US)

(72) Inventor: Greg Spiegel, Land O'Lakes, FL (US)

( * ) Notice: Subject to any disclaimer, the term of this patent is extended or adjusted under 35 U.S.C. 154(b) by 0 days.

(21) Appl. No.: 15/921,592

(22) Filed: Mar. 14, 2018

(51) Int. Cl.
*A63H 17/26* (2006.01)
*A63H 1/02* (2006.01)
*A63H 29/24* (2006.01)

(52) U.S. Cl.
CPC ..... *A63H 17/26* (2013.01); *A63H 1/02* (2013.01); *A63H 29/24* (2013.01)

(58) Field of Classification Search
CPC .... A63H 17/00; A63H 17/004; A63H 17/008; A63H 1/00; A63H 1/02; A63H 29/24; A63H 17/26
USPC ..... 446/429–431, 435, 456–457, 459, 462
See application file for complete search history.

(56) References Cited

U.S. PATENT DOCUMENTS 4,345,402 A * 8/1982 Hanson ..... A63H 29/00 446/430
5,674,105 A * 10/1997 Hamlin ..... A63H 17/008 446/430
5,746,641 A * 5/1998 Wong ..... A63H 17/004 446/431
7,927,173 B1 * 4/2011 Walterscheid ..... A63H 17/008 124/10
2007/0259602 A1 * 11/2007 Dunham ..... A63H 17/004 446/466

* cited by examiner

*Primary Examiner* — Kien T Nguyen
(74) *Attorney, Agent, or Firm* — Gulf Coast Intellectual Property Group

(57) ABSTRACT

A toy vehicle that is operable to be manually propelled by a user across a surface wherein a user provides a propelling force through utilization of an applied force member secured to the toy vehicle. The toy vehicle includes a body having a rear end and a front end. Wheels are rotatably mounted proximate the rear end and the front end of the toy vehicle. An applied force member is secured to the rear end of the toy vehicle. The applied force member is semicircular in shape having an upper portion and lower portion that are contiguously formed. A void is present between the upper portion and the lower portion and an opening is further present being contiguous with the void. The applied force member has a first position and a second position. A user transitions the applied force member to its second position by applying a force to the upper portion and lower portion. Releasing the applied force member so as to return the applied force member to its second position provides directional movement of the toy vehicle.

10 Claims, 2 Drawing Sheets

TOY VEHICLE

PRIORITY UNDER 35 U.S.C SECTION 119(E) & 37 C.F.R. SECTION 1.78

This nonprovisional application claims priority based upon the following prior U.S. Provisional Patent Application entitled: Toy Vehicle, Application No.: 62/473,071 filed Mar. 17, 2017, in the name of Greg Spiegel, which is hereby incorporated by reference for all purposes.

FIELD OF INVENTION

The present invention relates generally to toy vehicles, more specifically but not by way of limitation, miniature toy vehicles suitable for utilization by children wherein the toy vehicle of the present invention includes a user based applied force propulsion system.

BACKGROUND

As is known in the art, there are numerous types of toy cars available in the marketplace. Toy cars have been manufactured and sold for decades and are available in various diminished scales of the vehicle type they represent. These toy cars range from basic models used by hand and further include remote controlled electric powered vehicles. The latter example can be quite costly and as such be limited in its affordability in the market place. Manually powered toy vehicles are affordable and offer numerous types of alternatives in regards to their propulsion systems. Existing propulsion systems known in the art include but are not limited to winding gear drives.

One issue with existing technology is the lack of an applied force propulsion system. With the exception of a user manually pushing a toy vehicle, most propulsion systems for toy vehicles utilize items such as electric motors or tension gears. Both of the aforementioned are wear items which will fail over time rendering the toy vehicle undesirable.

Accordingly, there is a need for a toy vehicle that includes an applied force propulsion system having elements integrally formed with the vehicle facilitating the receipt of a portion of a user's fingers in order to allow a user to apply a force thereto so as to propel the vehicle.

SUMMARY OF THE INVENTION

It is the object of the present invention to provide a toy vehicle that includes an applied force propulsion system wherein the vehicle body is manufactured in various sizes and styles.

Another object of the present invention is to provide a toy vehicle having unique propulsion system wherein the vehicle body is operably coupled to at least two wheels and an axle.

A further object of the present invention is to provide a toy vehicle that includes an applied force propulsion system wherein the vehicle body includes a front end and a rear end.

Still another object of the present invention is to provide a toy vehicle that is placed in motion by a user utilizing an applied force wherein the vehicle has integrally formed with the rear end of the vehicle body an applied force member.

An additional object of the present invention is to provide a toy vehicle that utilizes an applied force propulsion system wherein the applied force member includes an upper portion and a lower portion.

Yet a further object of the present invention is to provide a toy vehicle that is placed in motion by a user utilizing an applied force wherein the upper portion and lower portion of the applied force member are arcuate in shape.

Another object of the present invention is to provide a toy vehicle having an applied force propulsion system wherein the upper portion and lower portion of the applied force member has a void intermediate thereto.

An alternate object of the present invention is to provide a toy vehicle that is placed in motion by a user utilizing an applied force wherein the lower portion of the applied force member includes a first edge and a second edge.

Still a further object of the present invention is to provide a toy vehicle having an applied force propulsion system wherein the upper portion of the applied force member includes a first edge and a second edge.

An additional object of the present invention is to provide a toy vehicle configured to be placed in motion through an applied force by a user wherein the first edges of the lower portion and the first edge of the upper portion of the applied force member are secured to the rear end of the vehicle body.

A further object of the present invention is to provide a toy vehicle having an applied force propulsion system wherein the second edges of the upper portion and lower portion of the applied force member are distal to the rear end of the vehicle body and rearward therefrom.

An alternative objective of the present invention is to provide a toy vehicle configured to be place in motion by an applied force by a user wherein the second edge of the upper portion and lower portion of the applied force member has an opening intermediate thereto.

Another object of the present invention is to provide a toy vehicle having an applied force propulsion system wherein the applied force member is manufactured from a reduced friction material.

Yet a further object of the present invention is to provide a toy vehicle configured to be propelled by an applied force wherein the opening and void of the applied force member function to additionally facilitate the releasable securing of the toy vehicle to an object such as but not limited to a writing utensil.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
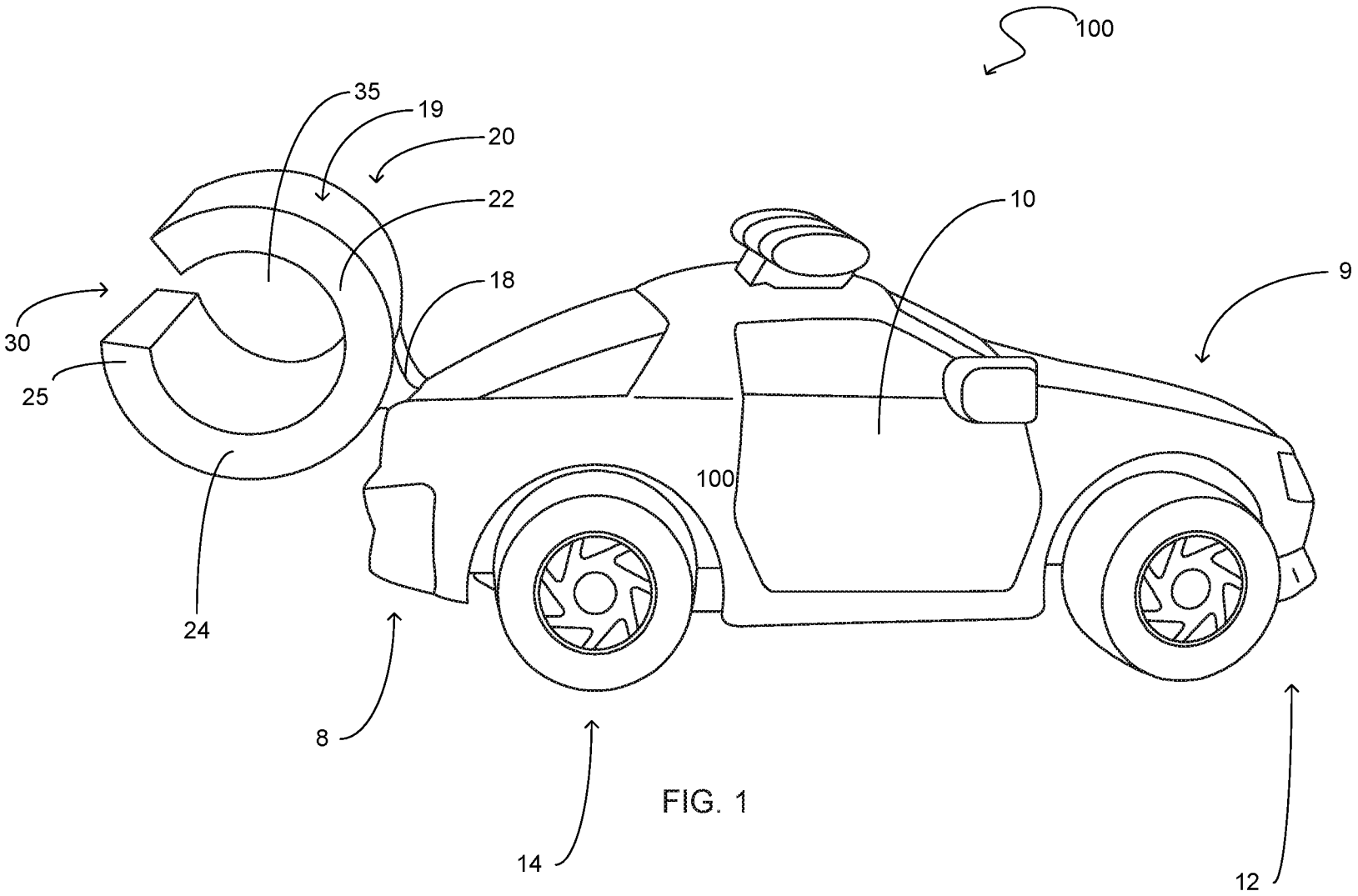
FIG. 1 is a side view of an embodiment of the present invention.

Referring now to the drawings submitted herewith, wherein various elements depicted therein are not necessarily drawn to scale and wherein through the views and figures like elements are referenced with identical reference numerals, there is illustrated a toy vehicle 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, the toy vehicle 100 includes a body 10 wherein the body 10 is manufactured from a suitable durable material such as but not limited to plastic. The body 10 includes a front end 9 and rear end 8. The body 10 includes a front pair of wheels 12 proximate the front end 9. A rear pair of wheels 14 are mounted proximate the rear end 8 of the body 10. While not illustrated herein, it should be understood by those skilled in the art that the front pair of wheels 12 and rear pair of wheels 14 consist of a wheel on opposing side of the body 10 rotatably mounted via an axle or other suitable technique. It is contemplated within the scope of the present invention while the toy vehicle 100 illustrated herein is embodied as a toy car that the body 10 of the present invention could be a motorcycle or other vehicle wherein the body 10 could have a single front wheel and rear wheel or more than the front pair of wheels 12 and rear pair of wheels.

Secured to the rear end 8 of the body 10 is the applied force member 20. The applied force member 20 is mounted to the rear end 8 of the body 10 via post 18. Post 18 is manufactured from a durable material such as but not limited to plastic. It is contemplated within the scope of the present invention that the applied force member 20 could be directly secured to the rear end 8 of the body 10 as an alternative to utilizing post 18.

Applied force member 20 includes an upper portion 22 and a lower portion 24. The upper portion 22 and lower portion 24 are contiguously formed wherein the applied force member 20 is formed a semi-circular shape. The upper portion 22 includes end 23 and lower portion 24 includes end 25 that are separated by an opening 30. The formation of the opening 30 creates the space needed for a user to bias the upper portion 22 and lower portion 24 inwards as will be further discussed herein. The applied force member 20 includes a void 35 wherein the void 35 is centrally disposed within the applied force member 20. The applied force member 20 is manufactured from a durable bendable material such as but not limited to plastic. It is also desirable within the scope of the present invention that the exterior surface 19 of the applied force member 20 has a reduced coefficient of friction. It is further contemplated within the scope of the present invention that the reduced coefficient of friction of the exterior surface 19 could be either intrinsic to the material of which the applied force member 20 is manufactured or an applied coating.

Figure 2:
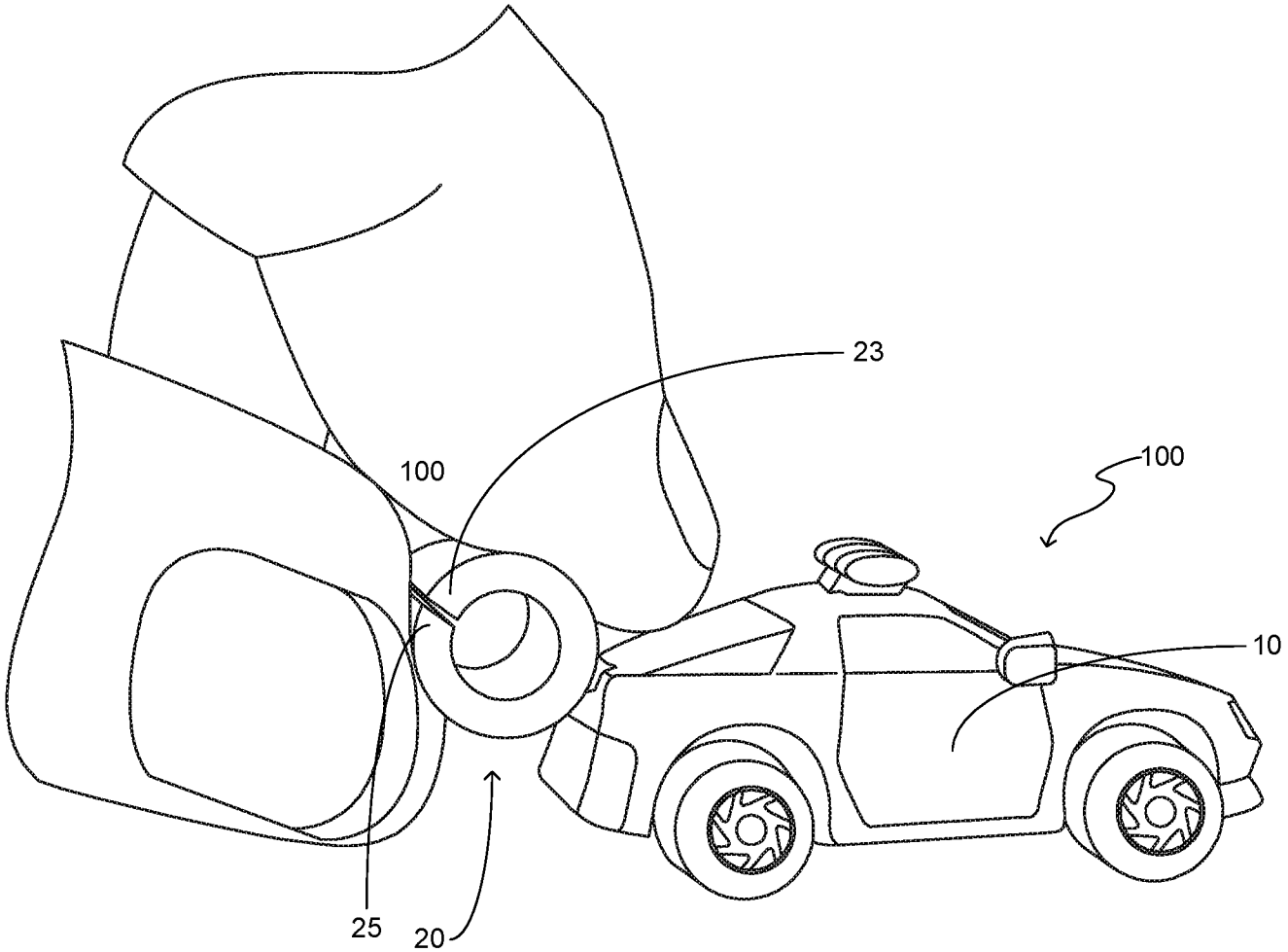
FIG. 2 is a side view of a preferred embodiment of the present invention wherein a user is placing the applied force member in its second position.

The upper portion 22 and lower portion 24 are movable intermediate a first position and a second position. As illustrated in FIG. 1 herein, in the first position, the upper portion 22 and lower portion 24 of the applied force member 20 are distal to each other with no force being applied thereto. In the first position opening 30 is such that the first end 23 and second end 25 are distal with respect to each other. Illustrated herein in particular in FIG. 2, the applied force member 20 is shown in its second position. In the second position of the applied force member 20, the upper portion 22 and lower portion 24 are biased inwards towards each other such that first end 23 and second end 25 are proximate each other. In the second position, the opening 30 is substantially closed and the void 35 has been compressed. When a user places the applied force member 20 in its second position, the applied force member 20 is loaded with stored energy prepared to be released in order to propel the toy vehicle 100. Once the user has utilized pressure from their fingers 99 as shown in FIG. 2 herein to place the applied force member 20 in its second position, the user will slidably traverse their fingers 99 in a rearward direction towards the opening 30. As the fingers 99 are released from the applied force member 20 the applied force member returns to its first position wherein the upper portion 22 and lower portion 24 spring back to an unbiased position. As the upper portion 22 and lower portion 24 spring back to their first positions the transfer of energy propels the toy vehicle 100 in a forward direction.

While the applied force member 20 is illustrated herein as being semicircular in shape and contiguous in form, it is contemplated within the scope of the present invention that the applied force member 20 could be formed in alternate shapes and/or consist of more than one contiguously formed element. By way of example but not limitation, the applied force member 20 could be comprised of an independent upper portion and lower portion that extend rearward from the rear end 8 of the toy vehicle. This alternate configuration could further include either arcuate shaped independent upper portion and lower portion or it is further contemplated that the independent upper portion and lower portion could be angularly mounted so as to achieve a desired configuration in order to provide a technique of propelling the toy vehicle 100.

It is further contemplated within the scope of the present invention that the preferred embodiment of the applied force member 20 illustrated herein is sized so as to be releasably secured a writing utensil such as a pen or pencil. The semicircular shape of the applied force member 20 having the opening 30 facilitates the ability for a user to insert a writing utensil into the opening 30 so as to place a writing utensil within the void 35 so as to releasably secure the toy vehicle to a writing utensil. It is further contemplated within the scope of the present invention that the applied force member 20 could be releasably secured to any cylindrical or rod shaped object of sufficient size for storage of the toy vehicle 100. Furthermore, concerning the alternate embodiment of the applied force member 20 discussed herein, it is contemplated within the scope of the present invention that the applied force member 20 could be releasably secured to alternate objects having a suitable mateable shape with the applied force member 20.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A toy vehicle that is manually propelled by a user to move the vehicle in a desired direction comprising:

A body, said body having a front end and a rear end, said body having a first pair of wheels proximate said front end, said body having a second pair of wheels proximate said rear end, said body being configured to traverse across a surface on said first pair of wheels and said second pair of wheels;

An applied force member, said applied force member being secured to said rear end of said body, said applied force member being semicircular in shape, said applied force member having an upper portion and a lower portion, said upper portion and said lower portion being contiguous; and Wherein said applied force member has a first position and a second position and wherein the applied force member is moved to its second position by a user applying a force on said upper portion and said lower portion.

2. The toy vehicle as recited in claim 1, wherein said applied force member further includes a void, said void being intermediate said upper portion and said lower portion.

3. The toy vehicle as recited in claim 2, wherein said upper portion of said applied member includes an end, said end being distal to said rear end of said body.

4. The toy vehicle as recited in claim 3, wherein said lower portion of said applied force member further includes an end, said end of said lower portion of said applied force member being distal to said rear end of said body.

5. The toy vehicle as recited in claim 4, wherein said applied force member further includes an opening, said opening being intermediate said end of said lower portion and said end of said upper portion, said opening being contiguous with said void of said applied force member.

6. The toy vehicle as recited in claim 5, wherein a user transitions said applied force member to said second position by applying a force to said upper portion and said lower portion, wherein in said second position said end of said lower portion and said end of said upper portion are proximate each other.

7. The toy vehicle as recited in claim 6, wherein the toy vehicle is propelled in a desired direction across a surface subsequent a user releasing said applied force member so as to transition said applied force member to said first position.

8. A toy vehicle that is manually propelled by a user to move the vehicle in a desired direction comprising:

A body, said body having a front end and a rear end, said body having a first pair of wheels proximate said front end, said body having a second pair of wheels proximate said rear end, said body being configured to traverse across a surface on said first pair of wheels and said second pair of wheels;

An applied force member, said applied force member being secured to said rear end of said body, said applied force member being semicircular in shape, said applied force member having an upper portion and a lower portion, said upper portion and said lower portion being contiguous, said applied force member further including a void, said void being intermediate said upper portion and said lower portion, said upper portion of said applied force member further having an end, said end of said upper portion being distal to said rear end of said body, said lower portion of said applied force member further having an end, said end of said lower portion being distal to said rear end of said body, said applied force member further having an opening, said opening of said applied force member being intermediate said end of said upper portion and said end of said lower portion, said opening being contiguous with said void providing access thereto; and Wherein said applied force member has a first position and a second position and wherein the applied force member is moved to its second position by a user applying a force on said upper portion and said lower portion.

9. The toy vehicle as recited in claim 8, wherein a user transitions said applied force member to said second position by applying a force to said upper portion and said lower portion, wherein in said second position said end of said lower portion and said end of said upper portion are proximate each other.

10. The toy vehicle as recited in claim 9, wherein the toy vehicle is propelled in a desired direction across a surface subsequent a user releasing said applied force member so as to transition said applied force member to said first position.

* * * * *